US006061882A

United States Patent [19]

Otte-Wiese

[11] Patent Number: 6,061,882

[45] Date of Patent: May 16, 2000

[54] CLAMPING DEVICE AND ASSOCIATED HOLDER

[75] Inventor: Klaus Otte-Wiese, Bochum, Germany

[73] Assignee: Padis Preisauszeichnung + Display Systeme GmbH & Co. Vertriebs-K.G., Bochum, Germany

[21] Appl. No.: 08/981,862

[22] PCT Filed: Jul. 2, 1996

[86] PCT No.: PCT/DE96/01218

§ 371 Date: Jan. 5, 1998

§ 102(e) Date: Jan. 5, 1998

[87] PCT Pub. No.: WO97/02556

PCT Pub. Date: Jan. 23, 1997

[30] Foreign Application Priority Data

Jul. 5, 1995 [DE] Germany ..... 195 24 535

[51] Int. Cl.[7] ..... B65D 33/00; G09F 15/00

[52] U.S. Cl. ..... 24/487; 24/543; 24/587

[58] Field of Search ..... 24/487, 458, 457, 24/531, 587, 67.11, 67.9, 543

[56] References Cited

U.S. PATENT DOCUMENTS

| | | | |
|---|---|---|---|
| 3,561,077 | 2/1971 | Grant | 24/487 |
| 3,597,813 | 8/1971 | Takahashi | 24/458 |
| 3,991,960 | 11/1976 | Tanaka | 24/458 |
| 4,944,072 | 7/1990 | Robson | 24/587 |
| 5,285,556 | 2/1994 | Shorin et al. | 24/587 |

FOREIGN PATENT DOCUMENTS

| | | | |
|---|---|---|---|
| 2533728 | 3/1984 | France . | |
| 2078849 | 1/1982 | United Kingdom | 24/487 |

*Primary Examiner*—Victor N. Sakran
*Attorney, Agent, or Firm*—John F. A. Earley; John F. A. Earley, III; Harding, Earley, Follmer & Frailey

[57] ABSTRACT

The invention concerns a clamping device for sheet products and an associated holding device.

14 Claims, 1 Drawing Sheet

CLAMPING DEVICE AND ASSOCIATED HOLDER

DESCRIPTION

Figure 1:
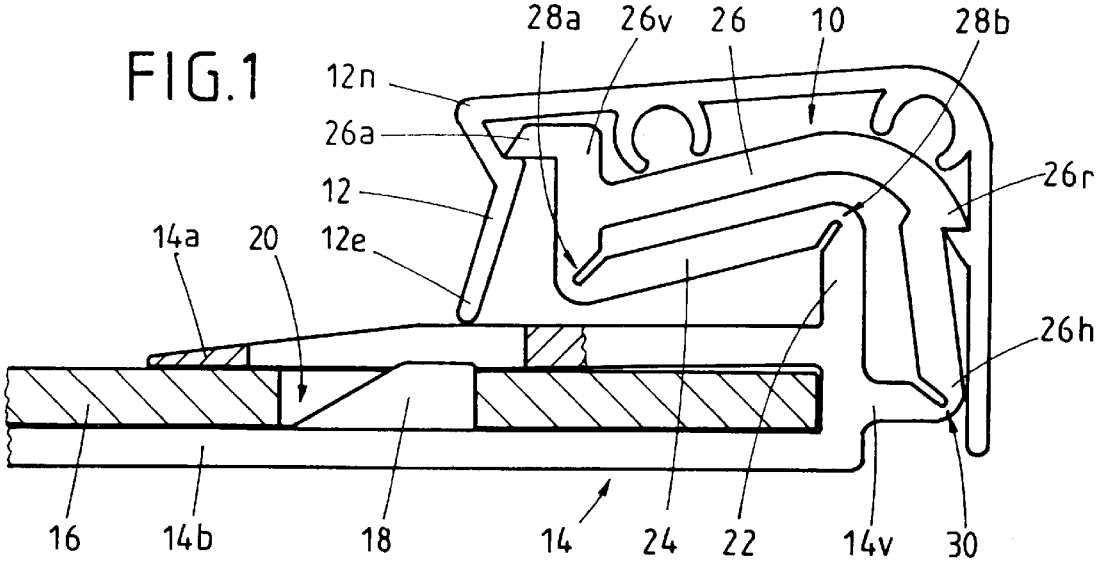

The invention concerns a clamping device for sheet products and an associated holding device.

A combined clamping/holding device is known from the DE 33 34 092 C2. There, it is described as a holding frame for a picture or similar planar objects and consists of two holding parts and a spring part. The two holding parts can be pivoted with respect to each other and are made of a comparably rigid, extruded synthetic material, one of the holding parts having a holding portion which is pressed against the planar object and the other holding part being beneath it by the spring part for clampingly holding the planar object. The spring part is integrally formed with the two holding parts by extruding and is made of a softer material than that of the two holding parts.

A holding frame of the type mentioned above has proven its worth in principle. However, the necessity to use different materials is a disadvantage.

Accordingly, it is an object of the invention to design a holding frame of the type mentioned above that it can be made of a material of one quality and the production is not limited to extruding (extrusion molding).

The invention is based on the realization that this object can be achieved by a constructive modification of the known holding frame.

Accordingly, the invention in its most general embodiment concerns a clamping device for sheet products having a holding part being securable to a frame or a plate, an elastically deformable bow being connected to the holding part via a pivoting bearing (Schwenklager), and a tilting part extending between the other end of the bow and the holding part, wherein, in pivoting the bow around the pivoting bearing, the tilting part being essentially resistant to bending can be transferred from a stable first position (clamping position) to a stable second position (release position) under parallel biasing of the bow or from the release position to the clamping position by canceling the bias of the bow, through joints at its ends.

Such a clamping device can be manufactured as discrete component of any length and size.

If, according to an embodiment, the bow and the tilting part are joined with material-fit (materialschlüssig), then the clamping device can be made simply and inexpensively of a synthetic material as injection molded part.

The clamping device is pushed with the holding part onto a plate, for example. By lifting the bow or the tilting part, a distance between the tilting part and the holding part is created for inserting a picture, for example. In lifting the bow or the tilting part, the bow is biased. If the bow or the tilting part is released before the tilting part has reached its stable second position (release position), the bias causes an automatic return of the bow (with the connected tilting part), the inserted picture being clamped and fixed between the tilting part and the holding part.

The constructive design with two stable positions (clamping position, release position) has the advantage that the clamping device also may be brought into a static (open) state. A slight touch on the bow in the direction towards the holding part causes the bow with the tilting part to snap back without great expenditure of force.

The pivoting bearing and/or the joints of the tilting part can be formed in different ways. According to an embodiment, they are formed by areas being weakened with respect to adjacent portions, that is having a smaller thickness of material.

Following the case of application mentioned above, the bow is L-shaped, for example, and in the clamping position the tilting part extends essentially parallel to the bow.

The path of pivoting of the clamping part and the bow are different because of the relative resistance to bending of the clamping part and its pivoting about the joints at the ends in relation to the bow being essentially elastic and the pivoting thereof about the pivoting bearing in the area of connection to the holding part.

About that, the following description of the figures will give further information.

According to another embodiment, the tilting part is formed with a portion projecting towards the holding part for holding the sheet product clampingly between itself and the holding part.

However, this is not necessary, because the clamping device also may serve for receiving a profiled bar which is placed or put onto the bow from the exterior. In this case, the profiled bar may be designed to take the function for holding clampingly the sheet product, that is, in the clamping position, to further project towards the holding part as the corresponding portion of the clamping part. A corresponding embodiment is also illustrated and described in the description of the figures.

In order to push the holding part onto a frame or a plate, it has for example a "fork-like" shape, that is an essentially U-cross-section. In this case, the plate to be inserted can be locked within the holding part, for example, if the holding part has a leading bevel on its inner surface. Accordingly, the plate has to have a corresponding opening, behind which the leading bevel catches in bringing them together.

The described clamping device may have a bar-like shape (and is then produced using an extruder, for example); but also several clamping devices may be assembled to a functional unit (holding device), the clamping devices being connected to each other by means of a profiled bar which can be placed onto the bows of the clamping devices.

The special value of this embodiment is that the profiled bar can be made of any material. For example, if it is made of aluminum, then the holding device altogether gets a particularly advantageous appearance. The profiled bar can be put onto the bow or be glued to it; also any other connection technique is possible.

Further characteristics of the invention follow from the features of the subclaims and the other application documents.

The invention will be explained in more detail below with an embodiment.

Figure 2:
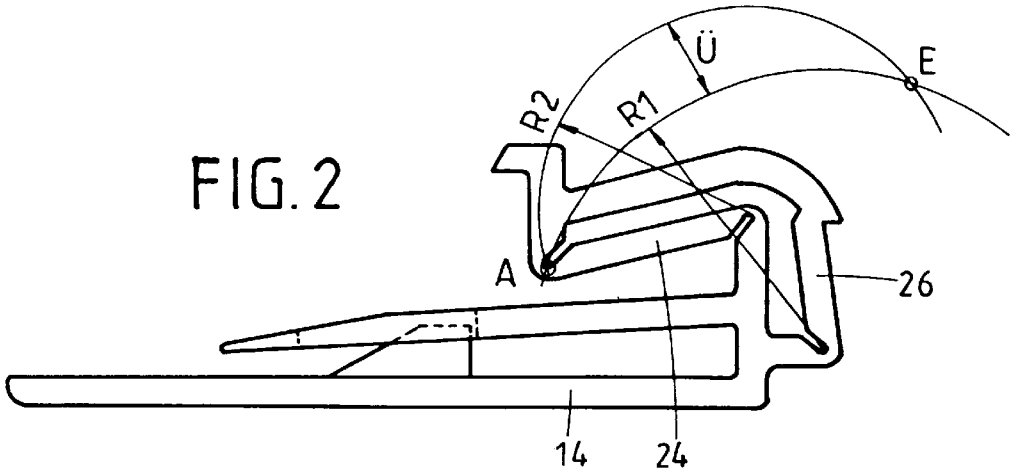
Figure 3:
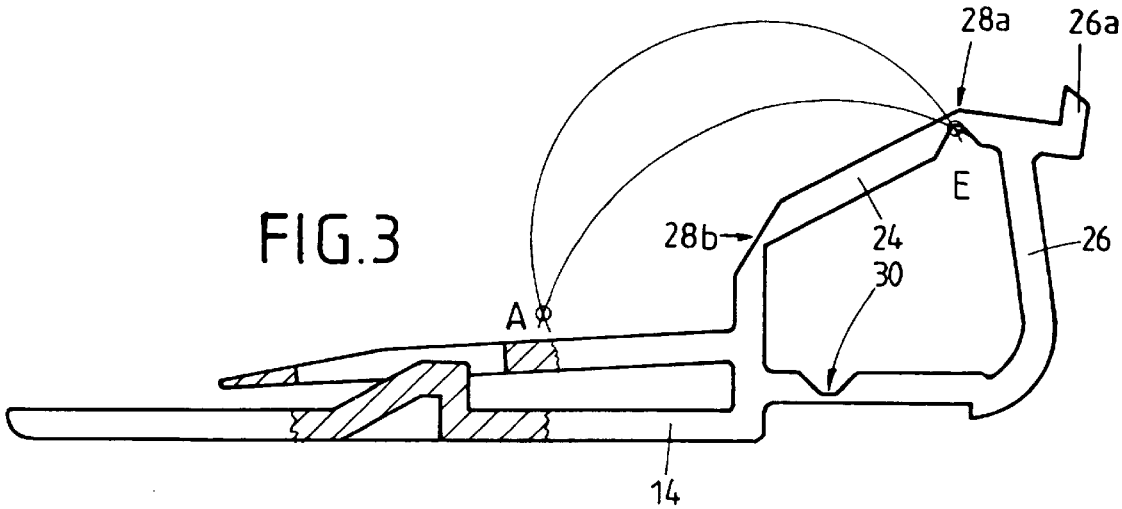

Schematically,

FIG. 1 shows a holding device according to the invention in association with a plate (in section), FIG. 2 shows the clamping device of FIG. 1 in the clamping position, FIG. 3 shows the clamping device of FIG. 1 in the release position.

The holding device illustrated in FIG. 1 consists of a clamping device 10 and a profiled bar 12 placed thereon.

The clamping device 10 comprises a holding part 14 having a U-shaped cross-section, the legs 14*a,* 14*b* of the holding part 14 receiving a plate 16 between themselves. For securing the plate 16 within the holding part 14, the inner surface of the leg 14*b* is formed with a leading bevel 18 which, in the illustrated locking position, engages positively in a corresponding opening 20 of the plate 16.

First of all, an arm 22 sticking-out in perpendicular upward direction extends from the connecting portion 14*v* of the holding part 14, to which a tilting part 24 is connected which verges into one end 26*v* of a bow 26 extending essentially parallel, in the illustrated clamping position, to the tilting part 24 and the arm 22 in spaced relationship thereto and being connected with its other end 26*h* to the connecting portion 14*v* of the holding part 14 with material-fit.

Areas 28*a, b* being weakened in material (here by corresponding slots) are located at both ends of the tilting part 24. In this manner, the tilting joints are formed, as described in more detail below.

In a similar way, also the end 26*h* of the bow 26 is connected to the connecting portion 14*v*, this region being hereinafter referred to as pivoting bearing 30.

As illustrated, the front portion 26*v* of the bow 26 is bent at right angle (portion 26*a*) and the bow 26 has a locking projection 26*r* along the L-shaped major portion thereof. The portion 26*a* bent at right angle and the locking projection 26*r* serve for receiving the said profiled bar 12 here being made of aluminum, the profiled bar 12 connecting two clamping devices 10 of the type mentioned above being disposed on the plate 16 in spaced relationship, and thus altogether providing a web-like holding device.

As shown in FIG. 1, the free front end 12*e* of the profiled bar 12 is lying, in the illustrated clamping position, on the leg 14*a* of the holding part 14 and may hold a picture (not illustrated), for example.

For opening the holding device, the user reaches behind the nose 12*n* of the profiled bar 12, for example, and moves that away from the holding part 14. While the normal pivoting radius of the tilting part 24 about the joint 28*b* is indicated by R1, the normal pivoting radius of the bow 26 about the pivoting bearing 30 is indicated by R2. The intersection of the radii R1 and R2 indicated by "Ü" describes the degree of hardness (the bias) or the restoring moment of the bow 26. The points indicated by "A" and "E" define the end positions named clamping position and release position, respectively, at the beginning.

FIG. 3 shows the clamping device 10 in the said release position.

I claim:

1. A clamping device for sheet products having 1.1 a holding part (14) being securable to a frame or a plate (16), 1.2 an elastically deformable bow (26) being connected with one end (26*h*) to the holding part (14) via a pivoting bearing (30), and 1.3 a tilting part (24) being essentially resistant to bending, extending between another end (26*v*) of the bow (26) and the holding part (14), wherein 1.4 in pivoting the bow (26) around the pivoting bearing (30), the tilting part (24) can be transferred from a stable first position (clamping position) to a stable second position (release position) under parallel biasing of the bow (26) and may be transferred from the release position to the clamping position by canceling the bias of the bow (26), via joints (28*a, b*) at its ends.

2. The clamping device according to claim 1, wherein the holding part (14), the bow (26) und the tilting part (24) are connected in a material-fit way.

3. The clamping device according to claim 1, wherein the holding part (14), the bow (26) and the tilting part (24) are made of the same material.

4. The clamping device according to claim 1, wherein at least one of the pivoting bearing (30) and the joints (28*a, b*) of the tilting part (24) is formed by regions of weakened material with respect to adjacent portions (26*v*, 14*v*).

5. The clamping device according to claim 1, wherein the bow (26) is L-shaped and the tilting part (24), in the clamping position, extends essentially parallel to the bow (26).

6. The clamping device according to claim 1, wherein the tilting part (24) is formed with a portion projecting towards the holding part (14) for clampingly holding the sheet product between itself and the holding part (14).

7. The clamping device according to claim 1, wherein the holding part (14) has a fork-like shape for putting it onto the frame or the plate (16).

8. The clamping device according to claim 7, wherein the fork-shaped holding part (14) has a leading bevel (18) on an inner surface (14*b*).

9. The clamping device according to claim 1 made of synthetic material.

10. The clamping device according to claim 1, produced as an injection molded part of synthetic material.

11. A holding device for sheet products, including a clamping device for sheet products having 1.1 a holding part (14) being securable to a frame or a plate (16), 1.2 an elastically deformable bow (26) being connected with one end (26*h*) to the holding part (14) via a pivoting bearing (30), and 1.3 a tilting part (24) being essentially resistant to bending, extending between another end (26*v*) of the bow (16) and the holding part (14), wherein 1.4 in pivoting the bow (26) around the pivoting bearing (30), the tilting part (24) can be transferred from a stable first position (clamping position) to a stable second position (release position) under parallel biasing of the bow (26) and may be transferred from the release position to the clamping position by canceling the bias of the bowe (26), via joints (28*a, b*) at its ends, said holding device for sheet products having at least two clamping devices (10) being spaced apart, which are connected by means of a profiled bar (12) which can be placed onto the bows (26) of the clamping devices.

12. The holding device according to claim 11, wherein the profiled bar (12) is an aluminum bar.

13. The holding device according to claim 12, wherein the profiled bar (12) can be clamped onto the bows (26).

14. The holding device according to claim 11, wherein the profiled bar (12) can be clamped onto the bows (26).

* * * * *